US006389324B2

(12) United States Patent
Takayuki et al.

(10) Patent No.: US 6,389,324 B2
(45) **Date of Patent: *May 14, 2002**

(54) EMBROIDERY STITCH DATA PRODUCING DEVICE WITH TWO-WAY TRANSMISSION FUNCTION

(75) Inventors: Kawasato Takayuki; Kongo Takeshi; Orii Akira; Tanaka Haruhiko, all of Hachioji (JP)

(73) Assignee: Janome Sewing Machine Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/140,029

(22) Filed: Aug. 26, 1998

(51) Int. Cl.[7] ..... G06F 7/66; D05B 1/00

(52) U.S. Cl. ..... 700/137; 700/19; 112/102.5; 112/470.05; 112/475.05

(58) Field of Search ..... 112/78, 475.18, 112/475.19, 475.05, 102.5, 103; 700/138, 137, 19

(56) References Cited

U.S. PATENT DOCUMENTS 5,065,682 A * 11/1991 Tajima et al. ..... 112/103
5,392,724 A * 2/1995 Kurono et al. ..... 112/102.5
5,740,057 A * 4/1998 Futamura ..... 700/138
5,950,551 A * 9/1999 Yoshida et al. ..... 112/102.5
5,964,168 A * 10/1999 Kongo et al. ..... 112/102.5
6,000,350 A * 12/1999 Koike et al. ..... 112/102.5
6,032,594 A * 3/2000 Komura ..... 112/102.5

* cited by examiner

*Primary Examiner*—William Grant
*Assistant Examiner*—Sheela S Rao
(74) *Attorney, Agent, or Firm*—Nields & Lemack

(57) ABSTRACT

An embroidery stitch data producing device with two-way data transmission function is disclosed, wherein a first embroidery stitch data producing part A comprises a connecting means 6, a control means 7, an image data memory 2, a stitch data producing means 3 and a stitch data memory 4, while a second embroidery stitch data producing part B comprises a second image data memory 51, a stitch data producing/compiling means 52 and a second stitch data memory 53. The image data memory 2, the stitch data producing means 3 and the stitch data memory 4 may be connected through the connecting means 6 to the second image data memory 51, the stitch data producing/compiling means 52 and the second stitch data memory 53 so that the data may be exchanged therebetween so as to be variously converted for optional embroider stitching.

8 Claims, 2 Drawing Sheets

EMBROIDERY STITCH DATA PRODUCING DEVICE WITH TWO-WAY TRANSMISSION FUNCTION

BACKGROUND OF THE INVENTION AND RELATED ART STATEMENT

The present invention relates to a device for producing embroidery stitch data.

It has been of a general practice that the stitch data to be used in an embroidering machine or a machine which is capable of embroidery stitching are prepared and sold by a maker actually producing the stitch data producing device.

In response to the recent wide spread demand of the user, an embroidery stitch producing device has been developed and sold by the maker for reading by means of an image sensor the image optionally and freely made by the user.

Although the conventional embroidery stitch data producing device is relatively simple in structure and easy in operation, the device is functionally limited, and still remains to be improved in response to a variety of demands from the user. For example, the conventional device fails to produce the stitch data for so many types of stitches which are often required in embroidery stitching. Further, the device fails to compile the stitch data, or to put the stitch data into optional combination, or to have a sufficient display, that is, the display is small and fails to give color indication.

Further the conventional device is not adapted to meet the recently increasing variety of data storing means which are generally available in the market.

It is the object of the invention to eliminate the defects and disadvantages of the prior art as mentioned above and to provide an improved embroidery stitch data producing device.

SUMMARY OF THE INVENTION

To attain the object as mentioned above, the embroidery data producing device with two-way data transmission function of the invention substantially comprises means for giving image data for representing an image, means for producing stitch data from the given image data, means for recoverably storing therein the stitch data as are produced, and means for connecting at least one of the image giving means, the stitch producing means and the stitch data storing means to an external data processing device.

Such an embroidery data producing device may be connected to an external computerized data processing device, so that the image data and/or the stitch data produced in the embroidery data producing device may be further processed and/or compiled and displayed in the external data processing device. On the other hand, the stitch data produced or compiled in the external data processing device may be stored in the memory of the embroidery data producing device so that the stitch data may be applied to an embroidering machine or a sewing machine capable of embroidery stitching.

Further, the embroidery data producing device with two-way data transmission function of the invention substantially comprises a first embroidery data producing means including means for giving image data for representing an image, means for producing stitch data from the given image data and means for recoverably storing therein the stitch data as are produced; and a second embroidery data producing means including at least means for producing stitch data; and means for connecting the second embroidery data producing means to at least one of the image data giving means, the stitch data producing means and the stitch data storing means of the first embroidery data producing means.

The second embroidery data producing means may be a personal computer.

With the second embroidery data producing means being so designed as to be connected to the first embroidery data producing means, the embroidery stitch data produced by the second embroidery data producing means may be stored in the memory of the first embroidery data producing means. Thus the embroidery stitch data produced by the second embroidery data producing means may be utilized in the embroidering machine.

Further, the second embroidery data producing means may comprise means for giving image data representing an image. The data giving means may be a scanner or means for reading out data from a memory such as CD.

The second embroidery data producing means may further comprise means for compiling the stitch data. The stitch data compiling means may compile the stitch data which are produced by the stitch producing means of the first embroidery data producing means, or the stitch data produced by the stitch data producing means of the second embroidery data producing means, or the stitch data which are prepared beforehand. This will increase the compilation ability of the device of the invention.

The second embroidery data producing means may further comprise means for producing indication data in accordance with the stitch data for indicating the image at a display, and means for converting the stitch data into the stitch data to be communicated.

DETAILED DESCRIPTION OF PREFERRED EMBODIMENT

The embodiment of the invention will now be described in reference to the attached drawings.

Figure 1:
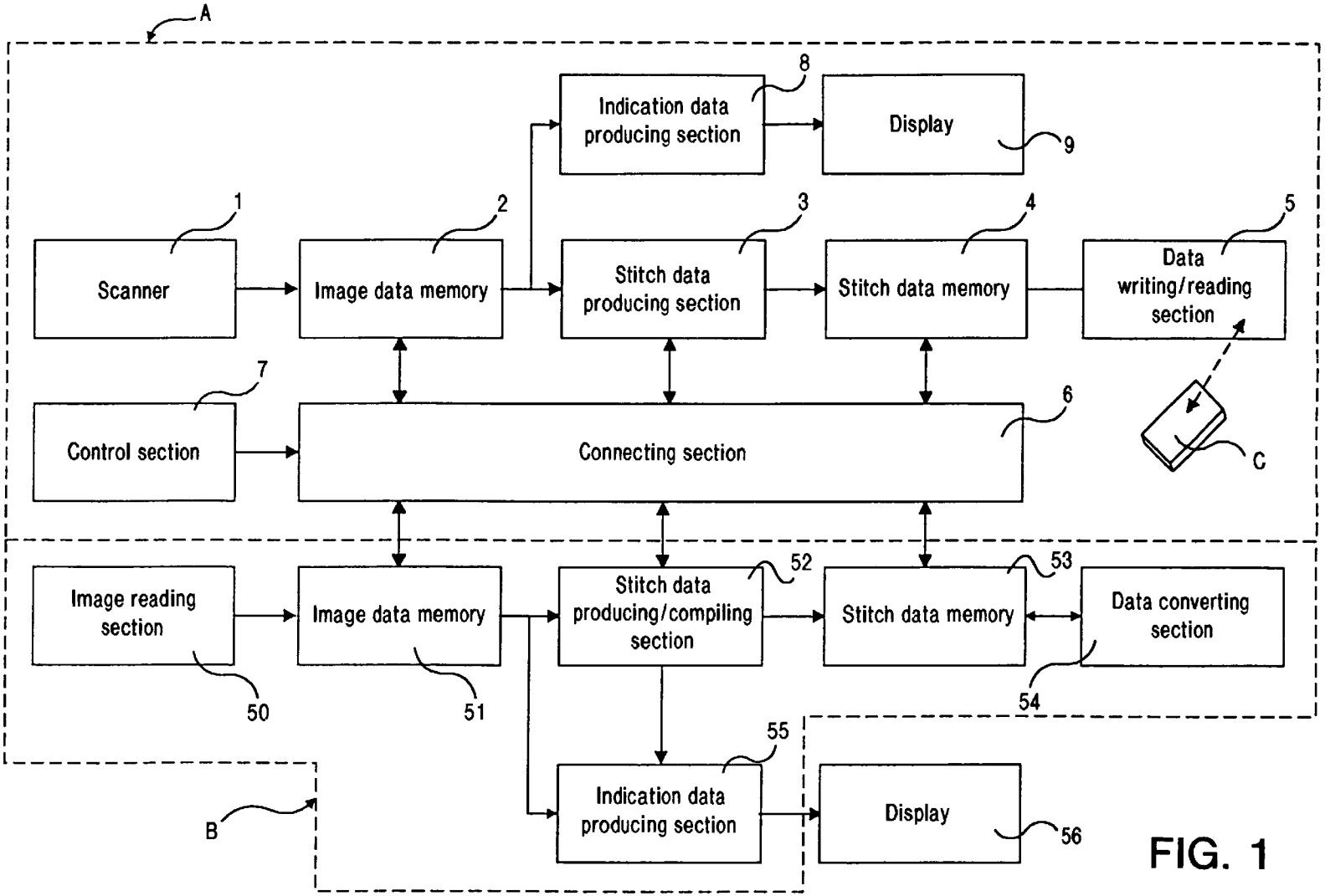
FIG. 1 is a block diagram showing a preferred embodiment of the invention.
Figure 2:
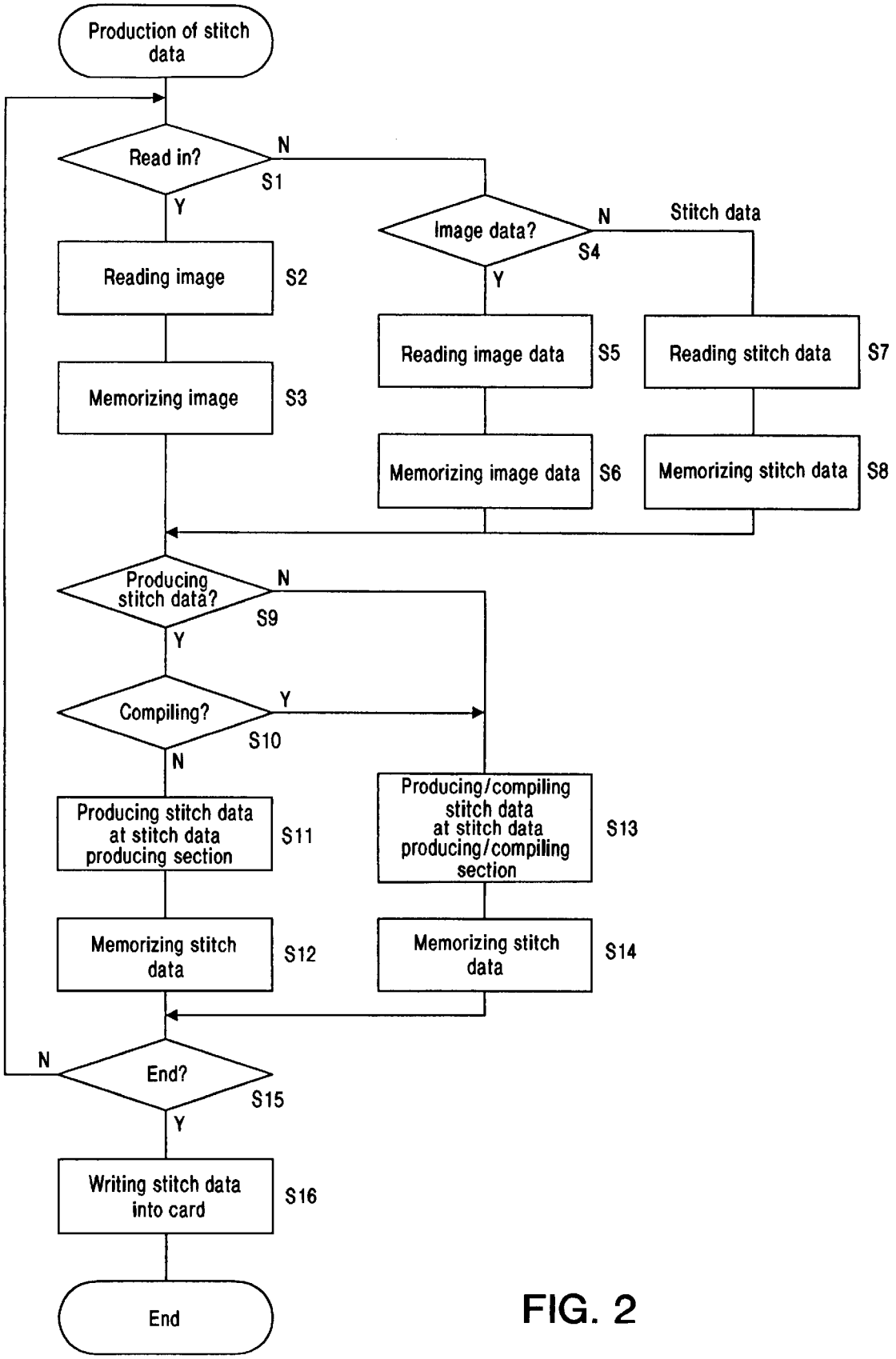
FIG. 2 is a flow chart showing the operations of the embodiment of the invention.

FIG. 1 shows an embodiment of the invention comprising a first embroidery stitch data producing part A and a second embroidery stitch data producing part B. In the first embroidery stitch data producing part A, a scanner 1 is provided to be used to read an image which may be drawn by the user. A memory 2 is provided to store therein the image data which are read in from the image by the scanner 1. A stitch data producing section 3 is provided to produce stitch data from the image data stored in the memory 2 which will determine the coordinates where a needle of a sewing machine drops. Another memory 4 is provided to store therein the stitch data produced by the stitch data producing section 3. A data writing/reading section 5 is provided to store the stitch data from the memory 4 into a memory means such as a RAM card C which may be attached to an embroidering machine or a sewing machine capable of embroidery stitching so that the machine may read in the stitch data from the RAM card C to perform embroidery stitching in accordance to the stitch data.

On the other hand, the image data stored in the image data memory 2 and the stitch data produced by the stitch data producing section 3 are sent to an indication data producing section 8 which is provided to produce indication data from the image data and the stitch data, thereby to indicate the image at a display 9. Thus the user is able to optically confirm the image at the display 9 which is based on the image data read in from an original image and the stitch data produced from the image data. The display may be a liquid crystal display which is generally used.

The first embroidery stitch data producing part A further includes a connecting section 6 through which the first embroidery stitch data producing part A may be connected to the second embroidery stitch data producing part B. At least one of the image data memory 2, the stitch data producing section 3 and the stitch data memory 4 may be connected to the second embroidery stitch data producing part B through the connecting section 6, so that the second embroidery stitch data producing part B may process the data of the first embroidery stitch data producing part A. In this embodiment, all of the image data memory 2, the stitch data producing section 3 and the stitch data memory 4 may be connected to the second embroidery stitch data producing part B.

The second embroidery stitch data producing part B may be a personal computer and the like having software which is capable of producing stitch data. The second embroidery stitch data producing part B comprises an image reading section 50 which may be a memory means such as CD, FD or a scanner for reading in image data. The image data which are read in are stored in an image data memory 51 and then are converted into stitch data in a stitch data producing/compiling section 52 which is designed to produce stitch data from the image data and compile the stitch data so that the stitch type may be changed, the pattern may be altered dimensionally and/or as to the angular position thereof, or a plurality of patterns may be put into an optional combination.

The second embroidery stitch data producing part B further comprises a stitch data memory 53 for storing therein the stitch data which are produced and/or compiled in the stitch data producing/compiling section 52. The stitch data memory 53 has a data converting section 54 connected thereto. The data converting section 54 is designed to convert the stitch data into the data which may be communicated.

The image data stored in the image data memory 51 and the stitch data produced in the stitch data producing/compiling section 52 are sent to an indication data producing section 55 in which the image data and the stitch data are converted into indication data to be indicated at a display 56 which is preferably a color display.

The image data memory 2, the stitch data producing section 3 and the stitch data memory 4 are connected through the connecting section 6 to the image data memory 51, the stitch data producing/compiling section 52 and the stitch data memory 53 so that the data may be exchanged therebetween under the control of a control section 7 of the first embroidery stitch data producing part A. More precisely, the data of the image data memory 2 may be transmitted to the stitch data producing/compiling section 52, or the data of the image data memory 51 may be transmitted to the stitch data producing section 3. Further the data may be transmitted from the stitch data producing/compiling section 52 or from the stitch data memory 53 to the stitch data memory 4 so that the data may be stored in the RAM card C through the data writing/reading section 5. Further the data may be transmitted from the image data memory 2 or from the stitch data producing section 3 to the display 56 so that the data may be indicated at the display 56.

The operations of the embodiment will now be described.

In case the scanner 1 is used to read an image under the control of the control section (step S1), the image is read in by use of the scanner 1 (step S2). The image data of the image are then stored in the image data memory 2 (step S3). In case the image reading section 50 is used to read the image (step S4), the image is read in by use of the image reading section 50 (step S5). The image data of the image are then stored in the image data memory 51 (step S6). Further it is possible to read in the stitch data directly. In this case, the stitch data are read in directly (step S7). The stitch data as are read in directly are then stored in the stitch data memory 53 (step S8).

Subsequently in case the stitch data are produced in the stitch data producing section 3 (step S9), it is discriminated if the stitch data are compiled (step S10). If not, the stitch data are produced in the stitch data producing section 3 (step S11). The stitch data as are produced are stored in the stitch data memory 4 (step S12). In case the data stitch producing/compiling section 52 is set, or data compilation is requested, the stitch data are produced and compiled in the data stitch producing/compiling section 52 (step S13). Then the stitch data as are produced and compiled are stored in the stitch data memory 53 (step S14).

Finally it is discriminated if the programming is end (step S15). When the programming is end, the stitch data are written into the RAM card C (step S16), and the programming is terminated.

Although the description of the invention has been made above in reference to a single and independent embroidery stitch data producing device, it is needless to say that the embroidery stitch data producing device may be incorporated in a sewing machine or in an embroidering machine.

According to the embroidery stitch data producing device of the invention as described above, the data may be exchanged at least between two embroidery stitch data producing parts enabling the user to produce various stitch data as desired.

The entire disclosure of Japanese Patent Application No. 9-252637 filed on Sep. 3, 1997 including specification, claims, drawings and summary is incorporated herein by reference in its entirety.

What is claimed is:

1. An embroidery stitch data producing device with two-way data transmission function comprising:

a first data processing device comprising:

means for providing image data representing an image;

means for producing stitch data from said provided image data;

memory means for recoverably storing therein the stitch data as are produced; and connection means adapted to connect at least one of said image data providing means, said stitch data producing means and said stitch data memory means of said first data processing device to another separate data processing device in such a manner that said separate data processing device can process data received via said connection means from at least one of said image data providing means, said stitch data producing means and said stitch data memory means.

2. An embroidery stitch data producing device with two-way data transmission function comprising:

a first embroidery stitch data producing means including means for providing image data respresenting an image, means for producing stitch data from said provided image data, a second embroidery stitch data producing means including at least a second means for producing stitch data; and means for connecting said second embroidery stitch data producing means to at least one of said image data providing means, said stitch data producing means and said stitch data memory means for processing by said second embroidery stitch producing means of at least one of said image data, said stitch data produced by said stitch data producing means and said stitch data stored by said memory means.

3. The device as defined in claim 2, wherein said connecting means is designed to connect said second embroidery stitch data producing means to said stitch data memory means so that the stitch data produced in said second embroidery stitch data producing means is stored in said stitch data memory means.

4. The device as defined in claim 2, wherein said second embroidery stitch data producing means includes a second means for providing image data representing an image.

5. The device as defined in claim 2, wherein said second embroidery stitch data producing means comprises means for compiling said stitch data, said stitch data compiling means being capable of compiling the stitch data produced by said first stitch data producing means of said first embroidery stitch data producing means, or the stitch data produced by said second stitch data producing means of said of said second embroidery stitch data producing means.

6. The device as defined in claim 2, wherein said second embroidery stitch data producing means further comprises means for producing indication data in accordance with said stitch data for indicating at a display the image to be embroidered.

7. The device as defined in claim 2, wherein said second embroidery stitch data producing means further comprises means for converting said stitch data into the stitch data being communicated.

8. The device as claimed in claim 3, wherein said second embroidery stitch data producing means includes a second means for providing image data representing an image.

* * * * *